US008461501B2

(12) United States Patent
Williams et al.

(10) Patent No.: US 8,461,501 B2
(45) Date of Patent: Jun. 11, 2013

(54) GUIDED MUNITIONS INCLUDING SELF-DEPLOYING DOME COVERS AND METHODS FOR EQUIPPING GUIDED MUNITIONS WITH THE SAME

(75) Inventors: Darin S. Williams, Tucson, AZ (US); Nicholas B. Saccketti, Tucson, AZ (US); David B. Hatfield, Oracle, AZ (US); Alexandra L. Blake, Tucson, AZ (US); Richard J. Wright, Tucson, AZ (US); Lawrence A. Westhoven, Jr., Tucson, AZ (US)

(73) Assignee: Raytheon Company, Waltham, MA (US)

( * ) Notice: Subject to any disclaimer, the term of this patent is extended or adjusted under 35 U.S.C. 154(b) by 264 days.

(21) Appl. No.: 12/917,699

(22) Filed: Nov. 2, 2010

(65) Prior Publication Data

US 2012/0104148 A1 May 3, 2012

(51) Int. Cl.

| | |
|---|---|
| ***F41G 7/22*** | (2006.01) |
| ***H01Q 1/42*** | (2006.01) |
| *F41G 7/00* | (2006.01) |
| *H01Q 1/00* | (2006.01) |

(52) U.S. Cl.

USPC ..... 244/3.16; 244/3.1; 244/3.15; 244/3.19; 343/872

(58) Field of Classification Search

USPC ..... 343/872, 873; 244/3.1–3.19, 117 R, 244/119, 121; 89/1.11, 1.1; 102/293, 374, 102/377, 378, 501

See application file for complete search history.

(56) References Cited

U.S. PATENT DOCUMENTS

| | | | | |
|---|---|---|---|---|
| 3,601,055 | A * | 8/1971 | Crockett | 102/377 |
| 3,674,227 | A * | 7/1972 | Jacobson et al. | 244/121 |
| 4,275,859 | A * | 6/1981 | Bleday | 244/121 |
| 4,753,169 | A * | 6/1988 | Shores | 102/293 |
| 4,867,357 | A * | 9/1989 | Inglis et al. | 244/121 |
| 5,457,471 | A * | 10/1995 | Epperson, Jr. | 343/872 |
| 5,814,754 | A * | 9/1998 | Mangolds | 89/1.11 |
| 6,679,453 | B2 * | 1/2004 | Steiner | 244/121 |
| 6,854,393 | B2 * | 2/2005 | Hazan | 102/501 |
| 7,093,799 | B1 * | 8/2006 | Dulat et al. | 244/121 |
| 8,058,595 | B2 * | 11/2011 | Koehler et al. | 244/3.1 |

OTHER PUBLICATIONS

Merems, Paul A. "Missile with Shroud that Separates in Flight," U.S. Appl. No. 12/696,123, filed Jan. 29, 2010.

Armtec Defense Products Co., combustible cartridge product description web page, 2 pages, undated; retrieved on Nov. 2, 2010 from the Internet at www.armtecdefense.com.

Williams, Darin S. et al. "Guided Munition Systems Including Combustive Dome Covers and Methods for Equipping Guided Munitions With the Same," U.S. Appl. No. 12/917,705, filed Nov. 2, 2010.

* cited by examiner

*Primary Examiner* — Bernarr Gregory

(74) *Attorney, Agent, or Firm* — Renner, Otto, Boisselle & Sklar, LLP

(57) ABSTRACT

Embodiments of a guided munition are provided, as are embodiments of a method for equipping a guided munition with a self-deploying dome cover. In one embodiment, the guided munition includes a munition body, a seeker dome coupled to the munition body, and a self-deploying dome cover disposed over the seeker dome. The self-deploying dome cover is configured to deploy and expose the seeker dome during munition flight in response to aerodynamic forces acting on the self-deploying dome cover.

20 Claims, 3 Drawing Sheets

GUIDED MUNITIONS INCLUDING SELF-DEPLOYING DOME COVERS AND METHODS FOR EQUIPPING GUIDED MUNITIONS WITH THE SAME

STATEMENT REGARDING FEDERALLY SPONSORED RESEARCH OR DEVELOPMENT

This invention was made with United States Government support under Contract Number W31P4Q-04-C-0059 with the Defense Contract Management Agency. The United States Government has certain rights in this invention.

TECHNICAL FIELD

The following disclosure relates generally to guided munitions and, more particularly, to embodiments of guided munitions including self-deploying dome covers.

BACKGROUND

Demands for increased munition portability, versatility, and ruggedness have lead to the recent development and implementation of containerized guided missiles, which are stowed within specialized launch containers prior to launch. As do non-containerized guided missiles, containerized guided missiles typically include a homing guidance system or "seeker" containing one or more electromagnetic ("EM") radiation sensors, which detect electromagnetic radiation emitted by or reflected from a designated target. A containerized guided missile also typically includes a nose-mounted seeker dome, which protects the seeker's components while enabling transmission of electromagnetic waves within the sensor bandwidth(s) through the dome and to the seeker's EM radiation sensors.

In contrast to many conventional guided missiles, containerized guided missiles are prone to dome contamination during missile launch. Guided by the walls of the surrounding launch container, exhaust from the missile's rocket motor flows over and around the missile body in an aft-fore direction during missile launch to blow-off the container cover and thereby facilitate passage of the missile through the container's open end. Direct exposure between the motor exhaust and seeker dome can thus occur during missile launch, which may result in the deposition of harsh chemicals, soot, and other exhaust materials over the dome's outer surface. Dome contamination can block, attenuate, or otherwise interfere with the transmission of electromagnetic signals through the dome and thereby negatively impact the missile's guidance capabilities.

It is known that a dome cover can be positioned over a missile dome to minimize or prevent dome contamination during missile launch. However, inflight removal of the dome cover is required to enable subsequent operation of the seeker's EM radiation sensors. Various types of deployment systems (e.g., actuators and timing electronics) have been developed that can effectively remove a dome cover by either ejecting the cover (if fabricated from a non-frangible material) or by initiating fracture of the cover (if fabricated from a frangible material) during or immediately after missile launch. While able to effectively remove a dome cover at a desired time of deployment, such deployment systems add undesirable complexity, cost, bulk, and weight to the guided missile. Tether-pull dome cover systems have been suggested that do not require an actuator or timing electronics; however, a relatively lengthy tether is typically required to ensure that the dome cover is not removed until the missile has cleared any forward-expanding exhaust plume created during missile launch. Consequently, tether-pull dome cover systems also tend to be undesirably heavy and bulky. In addition, tether-pull dome cover systems and certain non-frangible, actuator-deployed dome covers can produce undesirably large, high-energy debris upon dome deployment.

There thus exists an ongoing need to provide embodiments of a guided munition including a dome cover that mitigates most, if not all, of the above-described limitations. In particular, it would be desirable to provide embodiments of a guided munition, such as a containerized guided munition, including a dome cover that reliably self-deploys at a desired time without the aid of an actuator, timing electronics, or similar devices. Ideally, such a self-deploying dome cover would also be relatively compact, inexpensive to implement, and would produce little to no high-energy debris upon deployment. Other desirable features and characteristics of the present invention will become apparent from the subsequent Detailed Description and the appended Claims, taken in conjunction with the accompanying Drawings and this Background.

BRIEF SUMMARY

Embodiments of a guided munition are provided. In one embodiment, the guided munition includes a munition body, a seeker dome coupled to the munition body, and a self-deploying dome cover disposed over the seeker dome. The self-deploying dome cover is configured to deploy and expose the seeker dome during munition flight in response to aerodynamic forces acting on the self-deploying dome cover.

Embodiments of a method for equipping a guided munition including a seeker dome with a self-deploying dome cover are also provided. In one embodiment, the method includes the steps of providing a self-deploying dome cover configured to open during munition flight in response to aerodynamic forces acting on the self-deploying dome cover when the guided munition surpasses a predetermined airspeed, positioning the self-deploying dome cover over the seeker dome, and stowing the guided munition within a launch container.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
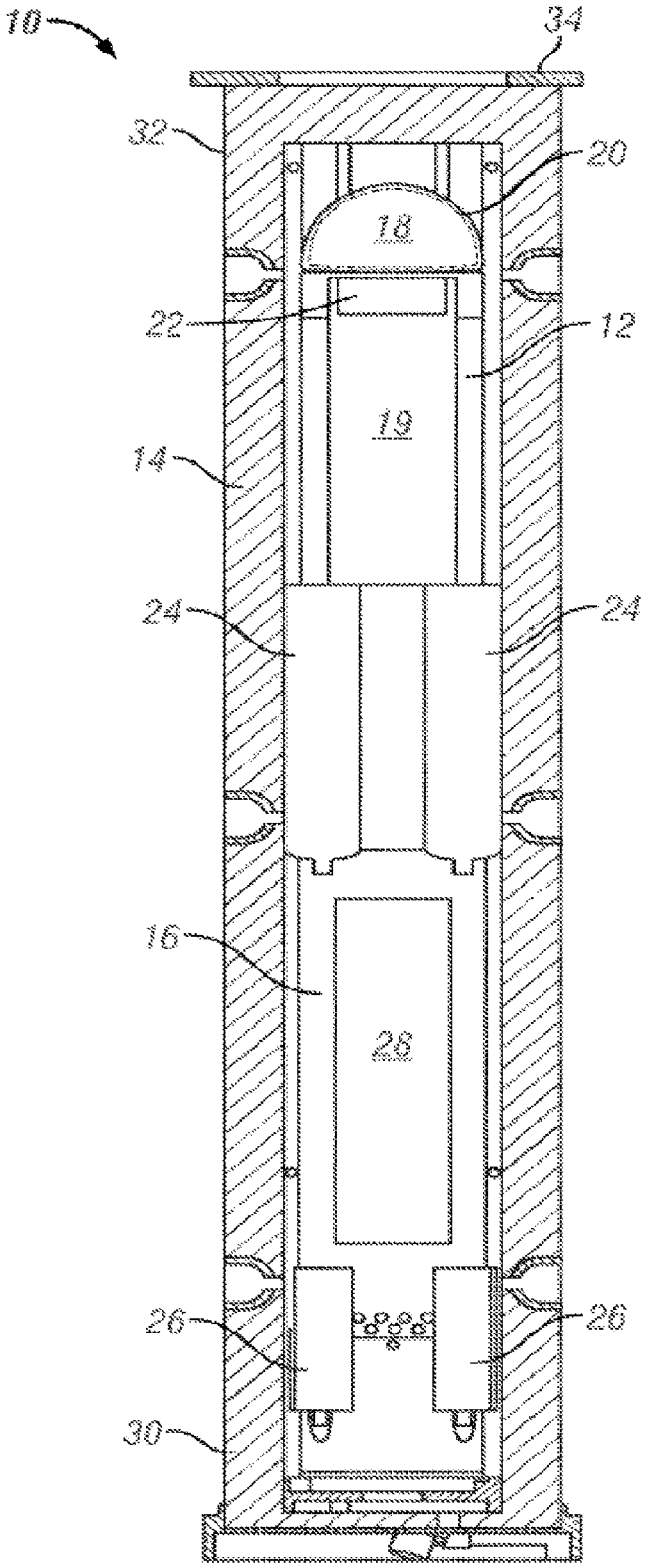
FIG. 1 is a cutaway view of an exemplary All-Up-Round including a launch container and a guided munition having a self-deploying dome cover in accordance with a first exemplary embodiment.

FIG. 1 is a cutaway view of an All-Up-Round ("AUR") 10 including a guided munition 12 stowed within a launch container 14 and illustrated in accordance with an exemplary embodiment. In this particular example, guided munition 12 assumes the form of a missile, such as a precision or loitering attack missile. AUR 10 can be implemented as a standalone launch unit or may instead be packaged with other All-Up-Rounds in, for example, a palletized launch system. As a specific example, AUR 10 may be one of several All-Up-Rounds packaged within a Container Launch Unit (commonly referred to by the acronym "CLU") included within a Non-Line of Sight Launch System (commonly referred to by the acronym "NLOS-LS"). The foregoing examples notwithstanding, embodiments of the self-deploying dome cover described herein are by no means limited to usage in conjunction within a particular type of launch system or in conjunction with a particular type of guided munition. Instead, embodiments of the self-deploying dome cover can be utilized in conjunction with any type of guided munition that includes a seeker dome transmissive to EM radiation or EM signals of the type described herein, whether or not the guided munition is containerized. Embodiments of the self-deploying dome cover are especially well-suited for utilization in conjunction with guided munitions that are containerized (i.e., initially stowed within a launch tube or other container) or otherwise shielded from significant fore-aft airflow prior to munition launch.

With continued reference to FIG. 1, guided munition 12 includes a munition body 16, a seeker dome 18 coupled or mounted to the forward end of munition body 16, and a homing guidance system or seeker 19 housed within a forward section of munition body 16. Seeker 19, in turn, includes one or more electromagnetic ("EM") radiation sensors 22 positioned within or adjacent to seeker dome 18; e.g., in one common implementation, sensors 22 are carried by a gimbal assembly (not shown) partially disposed within dome 18. During seeker operation or imaging, EM radiation sensors 22 detect electromagnetic radiation emitted by or reflected from a designated target or targets and transmitted through dome 18. Although not shown in FIG. 1 for clarity, seeker 19 will include a number of other conventionally-known components suitable for providing the desired homing functionalities. Such components may include, but are not limited to, guidance control electronics (e.g., a control card stack), antennae, internal navigational systems (e.g., global positioning systems and/or inertial navigational systems), power supplies (e.g., battery packs), and the like. Seeker 19 may also include a data link (e.g., a networked radio antenna) to enable the transmission of in-flight targeting updates and imaging data. More generally, guided munition 12 will likewise include various components that are conventionally-known in the aerospace or munition industry and not described in detail herein. Such components may include, but are not limited to, a plurality of manipulable flight control surfaces (e.g., wings 24 and thrust vector control vanes 26, as described more fully below), one or more warheads (not shown), and one or more propulsion devices, such as a solid propellant rocket motor (generically represented in FIG. 1 by box 28).

As previously indicated, seeker dome 18 is transmissive to one or more bandwidths of electromagnetic radiation emitted by or reflected from a designated target and detectable by EM radiation sensors 22. Seeker dome 18 will typically be transmissive to one or more of the visible, near infrared, midwave infrared, long wave infrared, and/or millimeter-wave radio frequency bandwidths. Seeker dome 18 can be formed from any material, currently known or later developed, that allows the transmission of EM radiation or signals through dome 18 within the desired sensor bandwidth(s) and that possesses sufficient structural strength to remain intact during munition handling, launch, and flight. By way of non-limiting example, seeker dome 18 may be formed from diamond, sapphire, zinc sulfide (ZnS), yttrium oxide ($Y_2O_3$) aluminum oxynitride (AlON), Spinel ($MgAl_2O_4$), magnesium fluoride ($MgF_2$), composite optical ceramics, and similar materials. Although by no means limited to a particular geometry, seeker dome 18 will typically be either hemispherical or ogival in shape.

EM radiation sensors 22 are configured to receive electromagnetic radiation through seeker dome 18 emitted from or from a designated target to provide passive guidance, semi-active guidance, or active guidance in the conventionally-known manner. EM radiation sensors 22 may comprise any number of electromagnetic radiation detection devices suitable for performing this purpose and for detecting radiation within any given frequency band of the electromagnetic spectrum including, but not limited to, one or more of the ultraviolet, visible, infrared (e.g., near-infrared, mid-infrared, and far-infrared), microwave, and radio wave frequencies. As a non-exhaustive list of examples, EM radiation sensors 22 may include one or more visible spectrum, semi-active laser, infrared, and/or millimeter wave detection devices. In the illustrated exemplary embodiment wherein guided munition 12 assumes the form of a precision attack missile, EM radiation sensors 22 conveniently include an uncooled imaging infrared sensor and a semi-active laser sensor. In another embodiment wherein guided munition 12 assumes the form of a loitering attack missile, EM radiation sensors 22 may comprise one or more laser radar sensors.

As noted above, guided munition 12 further includes a plurality of deployable flight control surfaces, which can be manipulated during munition flight by non-illustrated actuation means to provide aerodynamic guidance of guided munition 12 in accordance with homing data or command signals provided by seeker 19. In the illustrated example, specifically, guided munition 12 includes a plurality of wings 24 and a plurality of thrust vector control ("TVC") vanes 26, which are circumferential spaced around intermediate and aft portions of munition body 16, respectively. To facilitate storage within launch container 14, wings 24 and TVC vanes 26 are mounted to munition body 16 so as to be movable between a stowed or collapsed position (shown in FIG. 1) and a deployed position (shown in FIGS. 4 and 5, described below).

Launch container 14 can assume any form suitable for accommodating guided munition 12 prior to munition launch. In the exemplary embodiment illustrated in FIG. 1, launch container 14 assumes the form of an elongated launch tube including a closed end 30 and an open end 32. A container cover 34 is disposed over open end 32 to enclose launch container 14 and thereby protect munition 12 prior to munition launch. To initiate munition launch, rocket motor 28 is activated (e.g., via ignition of a non-illustrated ignition charge) to generate exhaust gases, which exit munition body 16 through a rocket nozzle (not shown) and provide forward thrust to munition 12. Guided by the walls of launch container 14, the exhaust gases flow over and around guided munition 12 in an aft-fore direction (i.e., upward in the illustrated orientation) to exert pressure on the inner face of container cover 34. When the pressure exerted on cover 34 surpasses a certain threshold, container cover 34 is effectively displaced from or blown-off of launch container 14 thereby facilitating the passage of guided munition 12 through open end 32. The forward end of guided munition 12 remains enveloped by rocket motor exhaust for a short distance of travel, typically equivalent to approximately one missile length, as the motor exhaust flowing through open end 32 forms a forward-expanding exhaust plume. Self-deploying dome cover 20 overlays or encloses seeker dome 18 to prevent contamination of dome 18 by the surrounding motor exhaust during the launch sequence and munition fly-out. However, shortly after munition launch, and specifically when guided munition 12 surpasses a predetermined positive airspeed, dome cover 20 self-deploys to expose the underlying seeker dome 18 and allow operation of EM radiation sensors 22 and, more generally, of seeker 19. The manner in which dome cover 20 is able to self-deploy at a predetermined juncture during munition flight without the aid of external devices (e.g., an actuator or timing electronics) is described more fully below in conjunction with FIGS. 2-5.

Figure 2:
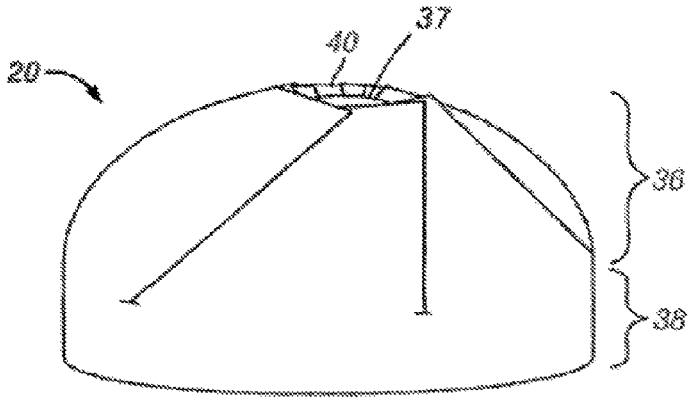
FIGS. 2 and 3 are side isometric views of the self-deploying dome cover shown in FIG. 1 in non-deployed (e.g., closed) and deployed (e.g., open) positions, respectively.
Figure 3:
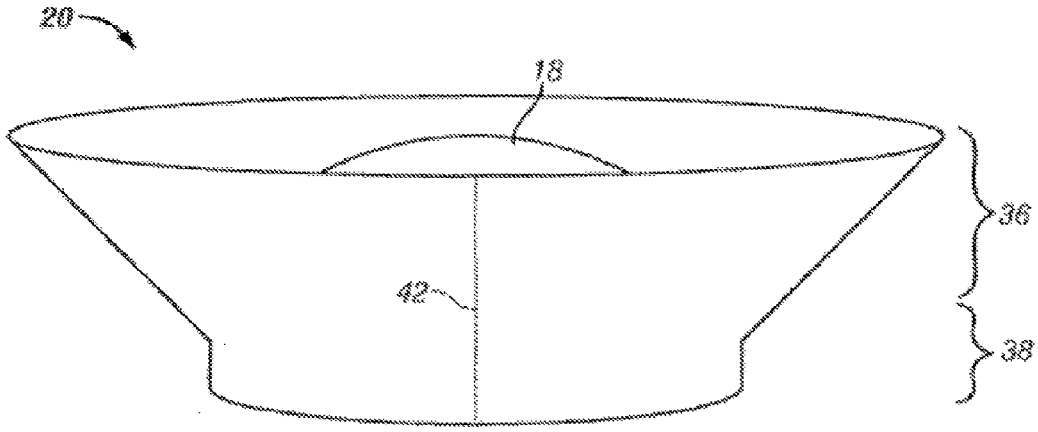

FIGS. 2 and 3 are isometric views of self-deploying dome cover 20 prior to and after deployment, respectively. Self-deploying dome cover 20 resides in the closed position shown in FIG. 2 wherein dome cover 20 overlays or encloses seeker dome 18 to prevent contamination of dome 18 prior to and during the initial stages of munition launch. Self-deploying dome cover 20 is configured to move into the open position (FIG. 3) during munition flight in response to aerodynamic forces acting on cover 20 when guided munition 12 (FIG. 1) surpasses a predetermined positive airspeed. In the illustrated example, specifically, self-deploying dome cover 20 includes a flexible shroud 36, which is folded over seeker dome 18 in the closed position (FIG. 2). During flight of munition 12 (FIG. 1), airflow enters flexible shroud 36 through a relatively small forward opening 40. When munition 12 surpasses a predetermined positive airspeed, the airflow received through opening 40 exerts pressure on the inner surfaces of flexible shroud 36 sufficient to cause shroud 36 to unfold or unfurl and thereby expose underlying seeker dome 18. Stated more simply, dome cover 20 opens or unfurls during munition flight as flexible shroud 36 fills with wind flowing (relative to munition 12) in a fore-aft direction during munition flight. As indicated in FIG. 2, flexible shroud 36 may be folded over seeker dome 18 in a spiral pattern such that the folds of shroud 36 are twisted about a longitudinal axis of munition body 16; however, the manner in which shroud 36 is folded over seeker dome 18 may vary amongst different embodiments.

Forward opening 40 may or may not provide a flow path through dome cover 20 to the interior of cover 20 and, therefore, to underlying seeker dome 18. If forward opening 40 provides a flow path through dome cover 20, it is preferred that any such flow path is relatively torturous or is otherwise sized and shaped to prevent or minimize the penetration of exhaust to the interior of dome cover 20. Seeker dome 18 may also be further protected from exhaust penetration through cover 20 by a protective membrane 37 (partially visible in FIG. 2), which may be positioned between the interior surface of dome cover 20 and the exterior surface of seeker dome 18. In one embodiment, protective membrane 37 assumes the form of a relatively thin sheet of paper or other material, which is retained in place by its disposition between cover 20 and dome 18 and possibly adhesively attached to the interior of cover 20 or munition body 16. To further block any exhaust leakage paths through cover 20, it may also be desirable to seal dome cover 20 by, for example, applying one or more layers of a coating material over the exterior of cover 20. Sealing of dome cover 20 may also deter the desiccation or drying-out of cover 20 during prolonged storage of AUR 10 in dry (e.g., desert) environments.

Figure 4:
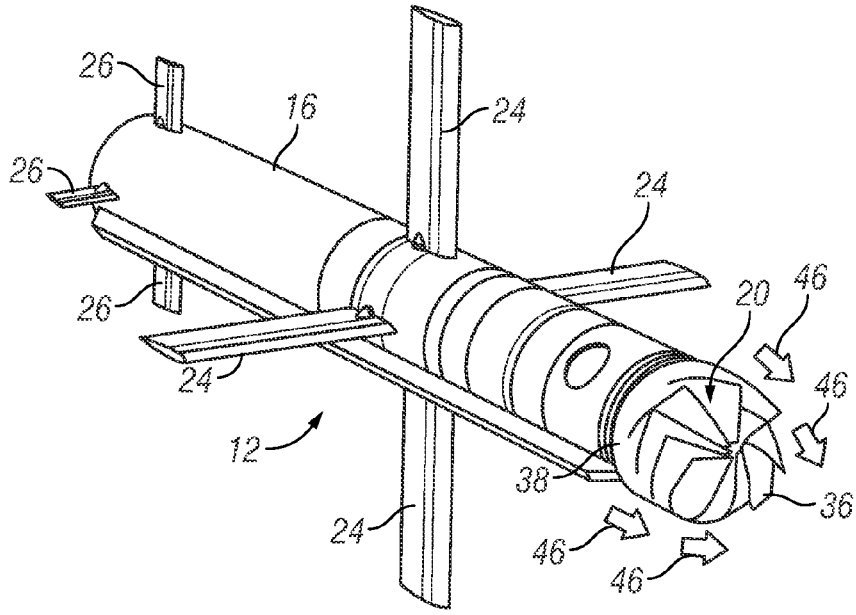
FIGS. 4 and 5 are isometrics views of the guided munition shown in FIG. 1 illustrating the self-deploying dome cover in non-deployed (e.g., closed) and deployed (e.g., open) positions, respectively.
Figure 5:
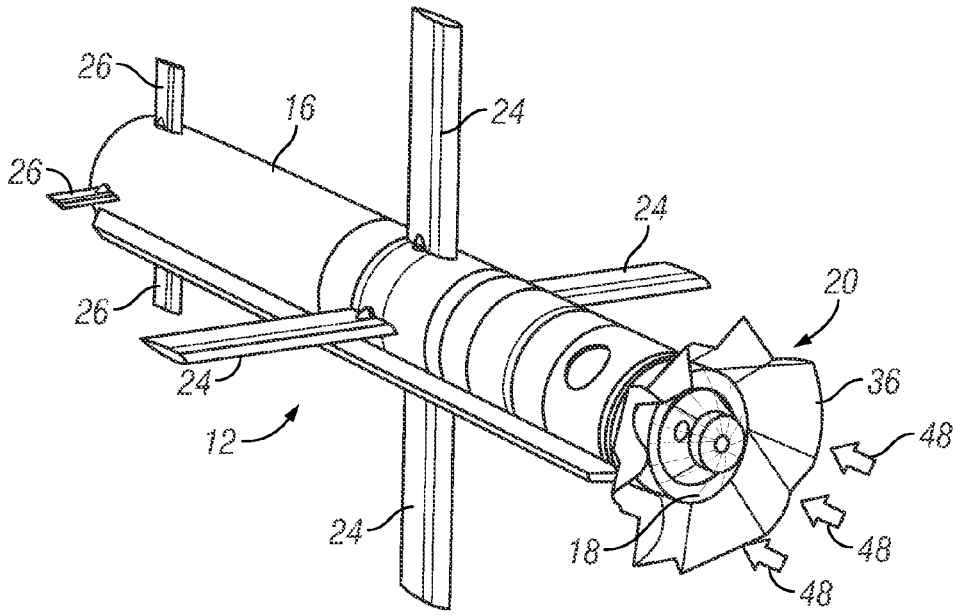

Self-deploying dome cover 20 further includes an aft collar portion 38, which is joined to the aft circumferential edge of flexible shroud 36; e.g., collar portion 38 and flexible shroud 36 may be integrally formed as a unitary sheet or sleeve of material, as described below. Collar portion 38 has a generally annular shape and extends around an outer circumference of munition body 16 proximate seeker dome 18. Collar portion 38, and more generally self-deploying dome cover 20, includes an aft opening through which a forward portion of munition body 16 is received, as generally shown in FIGS. 4 and 5 (described below). Flexible shroud 36 and collar portion 38 are conveniently, although not necessarily, integrally formed as one or more sleeves of lightweight, flexible material, such as a sheet of paper, fabric, or plastic. Notably, in embodiments wherein dome cover 20 is fabricated from such a flexible, lightweight material, jettison of dome cover 20 does not produce heavy, high energy debris that could increase the risk of foreign object damage to nearby objects. If desired, the outer surface of dome cover 20 may be coated with an ablative or thermally insulating material to provide added thermal isolation from hot exhaust flow during munition launch. In one preferred embodiment, dome cover 20 is formed from a polymeric film, such as the Kapton® brand polyimide film commercially available from E. I. du Pont de Nemours and Company (commonly referred to simply as "DuPont"), and coated with a silica-based ablative material.

Collar portion 38 is attached to munition body 16 to ensure that self-deploying dome cover 20 remains securely in place over seeker dome 18 until the desired time of deployment. In a preferred embodiment, collar portion 38 is attached to munition body 16 in a manner that enables collar portion 38, and therefore dome cover 20, to detach from body 16 in response to drag forces exerted on dome cover 20 when in the open position (FIG. 3); e.g., collar portion 38 may be adhesively attached to munition body 16 utilizing, for example, one or more strips of tape. In further embodiments, collar portion 38 may be detachably mounted to munition body 16 utilizing one or more pins, tabs, circumferential restraints (e.g., C-shaped springs or clamps), or other mechanical means capable of disengaging from munition body 16 and/or collar portion 38 at the desired time of deployment. In the illustrated example, inflight detachment of dome cover 20 is facilitated in at least two manners. First, as may be most easily appreciated by referring to FIG. 3, flexible shroud 36 is imparted with a frustoconical geometry such that the inner diameter of shroud 36 increases when moving in an aft-fore direction; as a result, forced tearing of flexible shroud 36 occurs during munition flight as shroud 36 fully opens and continues to fill with pressurized airflow. Second, as indicated in FIG. 3 by dashed line 42, dome cover 20 is scored, perforated, or otherwise structurally weakened in a longitudinal direction to promote tearing when cover 20 is subjected to post-deployment drag forces. By facilitating post-deployment detachment of dome cover 20 in this manner, any drag impulse created by the deployment of dome cover 20 during munition flight can be minimized. In addition, the likelihood of dome cover 20 catching on wings 24, TVC vanes 26, or other external component of munition 12 (e.g., a pitot tube) is reduced by designing dome cover 20 to tear or separate into at least one strip of material.

FIGS. 4 and 5 are isometric views of guided munition 12 illustrating self-deploying dome cover 20 prior to and after deployment, respectively. Referring initially to FIG. 4, guided munition 12 is illustrated during or immediately after munition fly-out from container 14 (not shown for clarity). At this juncture, guided munition 12 is enveloped in a forward-expanding exhaust plume (also not shown), which flows munition 12 in an aft-fore direction and imparts guided munition 12 with a negative airspeed. As indicated in FIG. 4 by arrows 46, the forward-expanding exhaust plume flows over the outer surface of self-deploying dome cover 20, which resides in a non-deployed or covering position to shield seeker dome 18 (FIG. 5) from the deposition of chemicals, soot, and other such exhaust materials. Due to its aerodynamic shape, as taken along the longitudinal axis of guided munition 12 in an aft-fore direction, self-deploying dome cover 20 remains securely in its closed position to block dome contamination even in the presence of high velocity aft-fore exhaust flow. Dome cover 20 is thus able to effectively prevent or significantly minimize contamination of seeker dome 18 during launch and fly-out of guided munition 12 from launch container 14.

FIG. 5 illustrates guided munition 12 after guided munition 12 has surpassed the predetermined airspeed during munition flight. As can be seen in FIG. 5, self-deploying dome cover 20 has deployed or opened in response to aerodynamic forces acting on cover 20 and, specifically, in response to the fore-aft airflow flowing into cover 20 through forward opening 40 (represented in FIG. 5 by arrows 48). After deploying in this manner, self-deploying dome cover 20 may subsequently detach from munition body 16 in response to drag forces exerted on dome cover 20. In this manner, dome cover 20 reliably self-deploys at a desired juncture during munition flight without the aid of an actuator, timing electronics, or other such conventionally-employed devices. Furthermore, dome cover 20 is highly compact when in a closed or covering position (FIGS. 2 and 4) and, consequently, requires the provision of little to no additional clearance within launch container 14 (FIG. 1). As a still further advantage, in embodiments wherein dome cover 20 is at least partially formed from a lightweight, flexible material of the type descried above, dome cover 20 is lightweight, readily portable, and produces little to no high-energy debris upon deployment.

It should thus be appreciated that there has been provided multiple exemplary embodiments of a guided munition, such as a containerized guided missile, including a dome cover that reliably self-deploys at a desired juncture without the aid of an actuator, timing electronics, or similar devices. Advantageously, the above-described exemplary self-deploying dome covers are relatively compact, inexpensive to implement, and produce little to no high-energy debris upon deployment. The foregoing has also provide exemplary embodiments of a method for equipping a guided munition including a seeker dome with a self-deploying dome cover. In one implementation, the above-described method included the steps of providing a self-deploying dome cover configured to open during munition flight in response to aerodynamic forces acting on the self-deploying dome cover when surpassing a predetermined airspeed, positioning the self-deploying dome cover over the seeker dome, and stowing the guided munition within a launch container. In embodiments wherein the self-deploying dome cover includes a flexible shroud, the step of positioning the self-deploying dome cover over the seeker dome may comprise folding the flexible shroud over the seeker dome.

Although, in the above-described exemplary embodiment, the self-deploying dome cover include a forward or central opening through which fore-aft airflow was received during munition flight, this need not be the case in all embodiments. For example, in lieu of a central opening (or in addition thereto), embodiments of the self-deploying dome cover may include one or more external drag features (e.g., sharp corners or other non-aerodynamic structures), which are formed on or mounted to the exterior of the dome cover and project radially outward therefrom. When exposed to high velocity airflow during munition flight, the drag features exert a pull force on the dome cover in a radially-outward direction to cause the dome cover to unfold or otherwise open when the guided munition surpasses a predetermined airspeed.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A guided munition, comprising:

a munition body;

a seeker dome coupled to the munition body; and a dome cover disposed over the seeker dome;

wherein the dome cover opens during flight of the munition, from a closed position to an open position, thereby exposing the seeker dome; and wherein the dome cover defines a forward opening when in the closed position, with airflow received through the opening exerting outward pressure on the dome cover to open the dome cover.

2. A guided munition according to claim 1 wherein the dome cover normally resides in a closed position in which the dome cover overlays the seeker dome to shield the seeker dome from contamination prior to munition launch.

3. A guided munition according to claim 2 wherein the dome cover is configured to move into an open position in response to aerodynamic forces acting on the dome cover when the guided munition surpasses a predetermined airspeed.

4. A guided munition according to claim 3 wherein the dome cover is attached to the munition body proximate the seeker dome and is configured to detach therefrom in response to drag forces generated during munition flight when the dome cover moves into the open position.

5. A guided munition according to claim 4 wherein the dome cover is structurally weakened in a longitudinal direction to promote tearing of the dome in response to drag forces generated during munition flight when the dome cover moves into the open position.

6. A guided munition according to claim 1 wherein the dome cover comprises a flexible shroud folded over the seeker dome.

7. A guided munition according to claim 6 wherein the flexible shroud is generally frustoconical in shape.

8. A guided munition according to claim 6 further comprises an aft portion coupled to the flexible shroud and attached to the munition body.

9. A guided munition according to claim 8 wherein the aft portion comprises a collar portion extending around at least a portion of the munition body.

10. A guided munition according to claim 9 wherein the collar portion and the flexible shroud are integrally formed.

11. A guided munition according to claim 8 wherein the aft portion is adhesively attached to the munition body proximate the seeker dome.

12. A guided munition according to claim 6 wherein the flexible shroud comprises a plurality of folds twisted about a longitudinal axis of the guided munition.

13. A guided munition according to claim 1 wherein the dome cover is at least partially coated with an outer ablative material.

14. A guided munition according to claim 1 wherein the dome cover has an aft opening through which a forward portion of the munition body is received.

15. A guided munition according to claim 1 further comprising a protective membrane disposed between the dome cover and the munition dome.

16. A guided munition according to claim 1 wherein the guided munition is configured to be stowed within a launch container prior to launch, and wherein the dome cover shields the seeker dome from exposure to rocket exhaust generated during launch of the guided munition.

17. A guided munition, comprising:

a munition body;

a seeker dome coupled to the munition body; and a dome cover disposed over the seeker dome, the dome cover configured to deploy and expose the seeker dome during munition flight in response to aerodynamic forces acting on the dome cover;

wherein the dome cover comprises a flexible shroud folded over the seeker dome; and wherein the flexible shroud comprises a plurality of folds twisted about a longitudinal axis of the guided munition.

18. A guided munition according to claim 17 wherein the flexible shroud comprises a forward opening into which wind flows during munition flight to cause the flexible shroud to unfold and expose the seeker dome.

19. A method for equipping a guided munition including a seeker dome with a dome cover, the method comprising the steps of:

providing a dome cover that is configured to open during munition flight from a closed position to an open position in response to aerodynamic forces acting on the dome cover when the guided munition surpasses a predetermined airspeed, wherein the dome cover defines a forward opening when in the closed position, with airflow received through the opening during the munition flight exerting outward pressure on the dome cover to open the dome cover;

positioning the dome cover over the seeker dome; and stowing the guided munition within a launch container.

20. A method according to claim 19 wherein the dome cover comprises a flexible shroud, and wherein the step of positioning the dome cover over the seeker dome comprises folding the flexible shroud over the seeker dome.

* * * * *